US008191311B2

(12) United States Patent
Sakamaki et al.

(10) Patent No.: US 8,191,311 B2
(45) Date of Patent: Jun. 5, 2012

(54) OPENING AND CLOSING APPARATUS

(75) Inventors: Ryousuke Sakamaki, Kosai (JP); Takahiro Iida, Toyohashi (JP)

(73) Assignee: Asmo Co., Ltd. (JP)

( * ) Notice: Subject to any disclaimer, the term of this patent is extended or adjusted under 35 U.S.C. 154(b) by 447 days.

(21) Appl. No.: 12/427,270

(22) Filed: Apr. 21, 2009

(65) Prior Publication Data

US 2009/0267786 A1 Oct. 29, 2009

(30) Foreign Application Priority Data

Apr. 24, 2008 (JP) ..... 2008-114334

(51) Int. Cl.
*E05F 15/06* (2006.01)

(52) U.S. Cl. ..... 49/27; 49/26; 49/28

(58) Field of Classification Search ..... 49/26, 27, 49/28, 360, 504; 296/146.9
See application file for complete search history.

(56) References Cited

U.S. PATENT DOCUMENTS 3,321,592 A * 5/1967 Miller ..... 200/61.43
5,072,079 A * 12/1991 Miller ..... 200/61.43
5,299,387 A * 4/1994 Miller et al. ..... 49/28
5,666,106 A * 9/1997 Nasman ..... 340/649
6,431,004 B2 * 8/2002 Ishihara et al. ..... 73/719
7,534,957 B2 * 5/2009 Yamaura et al. ..... 174/36
2006/0191203 A1 * 8/2006 Ueda et al. ..... 49/27
2007/0022819 A1 * 2/2007 Takeuchi et al. ..... 73/756
2007/0266635 A1 * 11/2007 Sugiura et al. ..... 49/27
2008/0052996 A1 * 3/2008 Sugiura ..... 49/28

FOREIGN PATENT DOCUMENTS

JP 2007163175 A 6/2007

* cited by examiner

*Primary Examiner* — Katherine W Mitchell
*Assistant Examiner* — Marcus Menezes
(74) *Attorney, Agent, or Firm* — Caesar, Rivise, Bernstein, Cohen & Pokotilow, Ltd.

(57) ABSTRACT

An opening and closing apparatus having an opening and closing body, a drive portion, a control portion, and a detecting device is disclosed. The detecting device has a sensor portion for detecting the capacitance between the sensor portion and an object that is in the proximity of the sensor portion or is contacting the sensor portion. The detecting device detects that the object is in the proximity of the sensor portion or is contacting the sensor portion based on the capacitance detected by the sensor portion. If the detecting device detects contact of the object with the sensor portion when the opening and closing body is not being moved, the control portion controls the drive portion to start opening the opening and closing body. If the detecting device detects that the object is in the proximity of the sensor portion when the opening and closing body is being closed, the control portion controls the drive portion to stop or reverse the movement of the opening and closing body.

2 Claims, 10 Drawing Sheets

OPENING AND CLOSING APPARATUS

BACKGROUND OF THE INVENTION

The present invention relates to an opening and closing apparatus that opens and closes an opening with an opening and closing body actuated by drive force, for example, of a motor.

Some vehicles such as automobiles open and close a door opening (opening) on a side by sliding a door panel (opening and closing body). Typically, such a vehicle has a power sliding door apparatus (opening and closing apparatus) for sliding the door panel by drive power, for example, of a motor. Some power sliding door apparatuses have detecting means for detecting whether an object exists between the edge of the door opening and the door panel to prevent an object from being caught between the door opening edge and the door panel. For example, Japanese Laid-Open Patent Publication No. 2007-163175 discloses detecting means that includes a sensor body arranged along the front edge of a door panel. Based on changes in the capacitance of the sensor body, the detecting means detects that an object is close to the sensor body. If the detecting means detects that an object is close to the sensor body when the door panel is closing, the power sliding door apparatus stops or reverses the movement of the door panel.

Some vehicles that are equipped with a power sliding door apparatus have a touch sensor for commanding the door panel to open. The touch sensor includes a touch sensing electrode. The touch sensor detects whether an object (for example, a part of a human body) has contacted the touch sensing electrode based on changes in the capacitance of the touch sensing electrode. The touch sensing electrode is attached, for example, to a front door panel located in front of a sliding door panel so as to be exposed to the outside. A power sliding door apparatus with a touch sensor causes a door panel to open when the touch sensor detects that on object contacts a touch sensing electrode.

However, in a vehicle having a detecting means and a touch sensor as described above, the touch sensor and the touch sensing electrode need to be separately installed in the vehicle. This increases the number of assembly steps and complicates the assembly.

Accordingly, it is an objective of the present invention to reduce the number of assembly steps of an opening and closing apparatus that has a function to prevent an object from being accidently caught and a function to cause an opening and closing body to start opening based on contact of an object.

To achieve the foregoing objective and in accordance with one aspect of the present invention, an opening and closing apparatus including an opening and closing body, a drive portion, a detecting device, and a control portion is provided. The opening and closing body opens and closes an opening formed in an opened and closed body. The drive portion actuates the opening and closing body. The detecting device has a sensor portion for detecting the capacitance between the sensor portion and an object that is in the proximity of the sensor portion or is contacting the sensor portion. The sensor portion is located at a closing end of the opening and closing body that is on the leading side when the opening and closing body is being closed. At least part of the sensor portion is exposed to the outside of the opened and closed body when the opening is fully closed by the opening and closing body. The detecting device detects whether or not the object is in the proximity of the sensor portion or is contacting the sensor portion based on the capacitance detected by the sensor portion. The control portion controls the drive portion. If the detecting device detects contact of the object with the sensor portion when the opening and closing body is not being moved, the control portion controls the drive portion to start opening the opening and closing body. If the detecting device detects that the object is in the proximity of the sensor portion when the opening and closing body is being closed, the control portion controls the drive portion to stop or reverse the movement of the opening and closing body.

DESCRIPTION OF THE PREFERRED EMBODIMENT

A first embodiment of the present invention will now be described with reference to the drawings.

Figure 1:
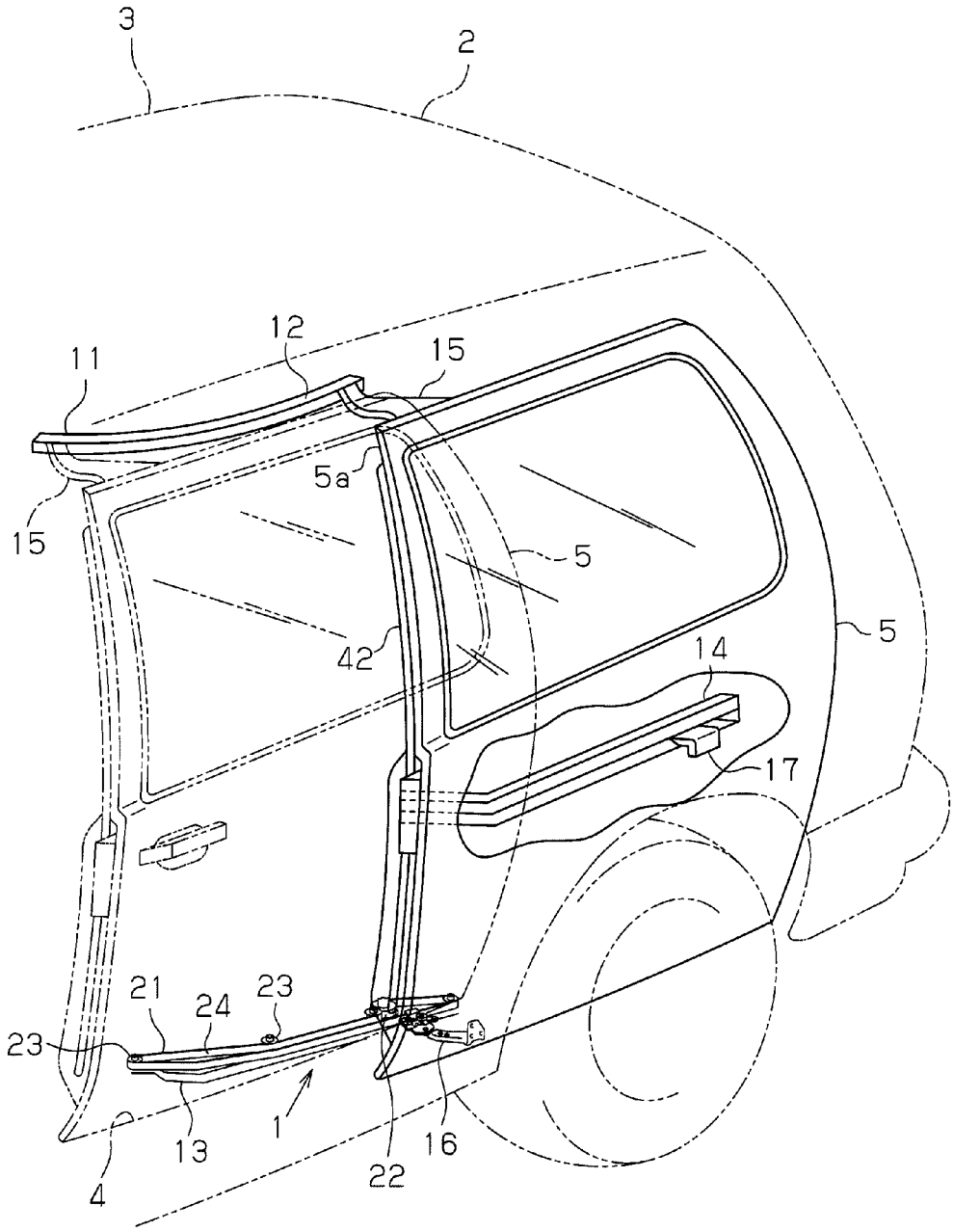
FIG. 1 is a perspective view illustrating a vehicle equipped with a power sliding door apparatus according to a first embodiment of the present invention.
Figure 2:
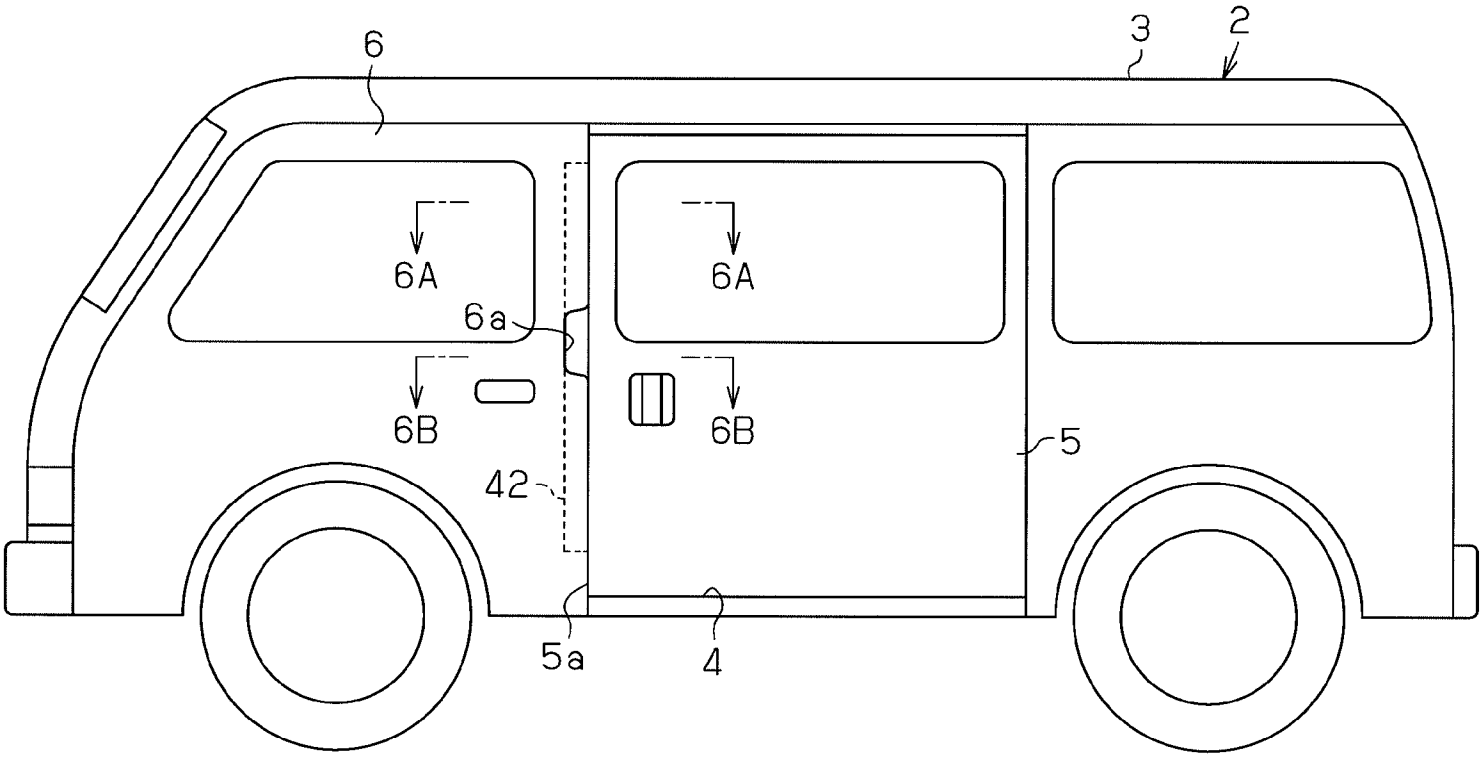
FIG. 2 is a side view showing the vehicle of FIG. 1.

FIG. 1 illustrates a vehicle 2 equipped with an opening and closing apparatus, which is a power sliding door apparatus 1. As shown in FIG. 1, the vehicle 2 includes an opened and closed body made of a conductive metal material, which is a vehicle body 3. A rectangular opening, which is a door opening 4, is formed in the left side of the vehicle body 3. The door opening 4 is opened and closed with a rear door panel 5 made of a conductive metal material. The rear door panel 5 has a rectangular shape in accordance with the shape of the door opening 4. As shown in FIG. 2, a front door panel 6 made of a conductive metal material is provided in front of the door opening 4. The front door panel 6 is a trapezoidal plate.

As shown in FIG. 1, the rear door panel 5 is attached to the vehicle body 3 with an actuating mechanism 11. The rear door panel 5 is movable in the front-rear direction so as to open and close the door opening 4. A lock mechanism (not shown), for example, a latch is provided in the rear door panel 5. The lock mechanism immovably locks the rear door panel 5 with respect to the vehicle body 3 when the rear door panel 5 closes the door opening 4, that is, when the rear door panel 5 is at the fully closed position (that is, the state shown in FIG. 2). A half latch detecting portion (not shown), which is composed, for example, of a limit switch, is provided in the vicinity of the lock mechanism. The half latch detecting portion outputs a half latch detection signal to a control circuit device 81 (see FIG. 3) of the power sliding door apparatus 1 if the lock mechanism is in a half latched state.

The actuating mechanism 11 is composed of an upper rail 12, a lower rail 13, and a center rail 14 provided in the vehicle body 3, and an upper arm 15, a lower arm 16, and a center arm 17 provided in the rear door panel 5.

The upper rail 12 and the lower rail 13 are respectively provided in an upper portion and a lower portion of the door opening 4 in the vehicle 2, and extend along front-rear direction of the vehicle 2. The center rail 14 is provided in a substantially center in the up-down direction of a part rearward of the door opening 4 in the vehicle 2, and extends along the front-rear direction of the vehicle 2. Each of the rails 12 to 14 is formed in such a manner as to extend linearly along the front-rear direction of the vehicle 2. A front end of each of the rails 12 to 14 is curved toward the interior of the passenger compartment.

The arms 15 to 17 are respectively fixed to positions of an upper portion, a lower portion, and a center portion in a side surface facing the interior of the passenger compartment of the rear door panel 5. The upper arm 15 is coupled to the upper rail 12. The lower arm 16 is coupled to the lower rail 13. The center arm 17 is coupled to the center rail 14. The arms 15 to 17 are respectively guided by the rails 12 to 14 so as to be movable along the front-rear direction of the vehicle 2.

Figure 3:
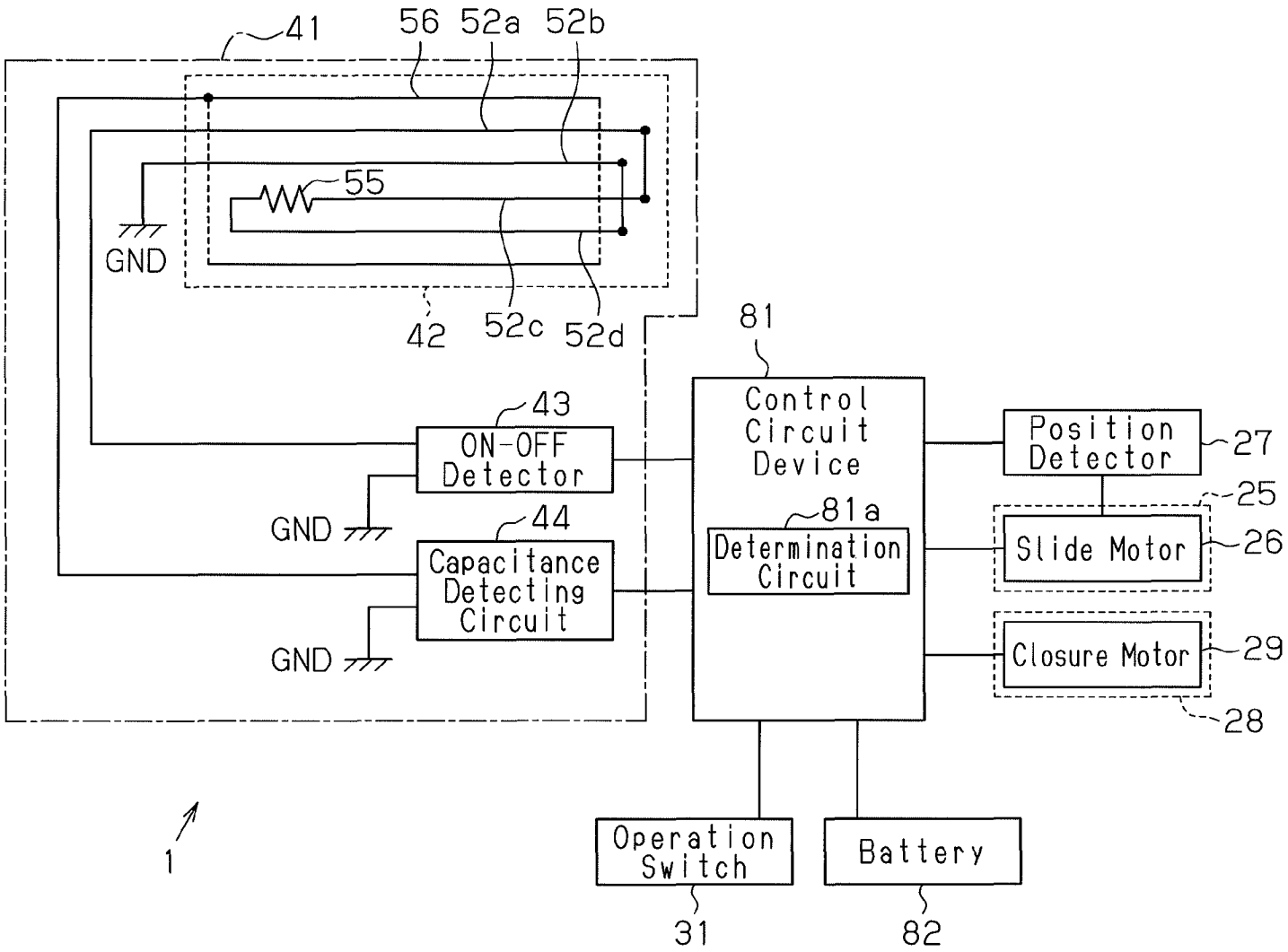
FIG. 3 is an electrical configuration of the power sliding door apparatus of FIG. 1.

The lower arm 16 is moved forward and rearward by a drive mechanism 21. More specifically, the drive mechanism 21 includes a drive pulley 22 and a plurality of driven pulleys 23 at positions closer to the passenger compartment than the lower rail 13. The pulleys 22, 23 are each rotatable about a shaft extending in the up-down direction of the vehicle 2. An endless belt 24 is wound around the drive pulley 22 and the driven pulleys 23. A distal end portion of the lower arm 16 is fixed to the endless belt 24. As shown in FIGS. 1 and 3, the drive mechanism 21 includes a slide actuator 25 connected to the drive pulley 22. The slide actuator 25 is located in the passenger compartment. The slide actuator 25 is provided with a slide motor 26 and a speed reducing mechanism (not shown), which reduces the speed of rotation of the slide motor 26 and transmits the rotation to the drive pulley 22. When the slide motor 26 is driven, the drive pulley 22 is rotated. Then, the endless belt 24 is rotated to move the lower arm forward and rearward. The rear door panel 5 is thus slid forward and rearward.

A position detector 27 for detecting rotation of the slide motor 26 is located in the slide actuator 25. The position detector 27 includes, for example, a permanent magnet and a Hall IC (not shown). The permanent magnet rotates integrally with the rotary shaft (not shown) of the slide motor 26 or with the reducing gear (not shown) of the speed reducing mechanism, and the Hall IC is arranged to face the permanent magnet. The Hall IC outputs, as position detection signals, pulse signals in accordance with changes in the magnetic field of the permanent magnet caused by rotation of the permanent magnet.

The drive mechanism 21 includes a closure actuator 28 located in the rear door panel 5. The closure actuator 28 is provided with a closure motor 29 and a speed reducing mechanism (not shown), which reduces the speed of rotation of the closure motor 29. When the closure motor 29 is driven, the rear door panel 5 is moved to a position where the rear door panel 5 is lockable by the lock mechanism.

The power sliding door apparatus 1 also includes an operation switch 31 electrically connected to the control circuit device 81. When an occupant of the vehicle 2 operates the operation switch 31 to open the door opening 4, the operation switch 31 outputs to the control circuit device 81 an open signal, which is a command for sliding the rear door panel 5 so as to open the door opening 4. On the other hand, when the occupant of the vehicle 2 operates the operation switch 31 to close the door opening 4, the operation switch 31 outputs to the control circuit device 81 a close signal, which is a command for sliding the rear door panel 5 so as to close the door opening 4. The operation switch 31 is provided in a predetermined portion (for example, in the dashboard) within the passenger compartment, on a side of the rear door panel 5 inside the passenger compartment, or in a portable item (not shown) carried together with the ignition key.

The power sliding door apparatus 1 has an object detecting device 41 for detecting an object that is close to or contacts a front end 5*a* of the rear door panel 5. The object detecting device 41 includes a sensor portion 42, an ON-OFF detector 43, and a capacitance detecting circuit 44.

Figure 4:
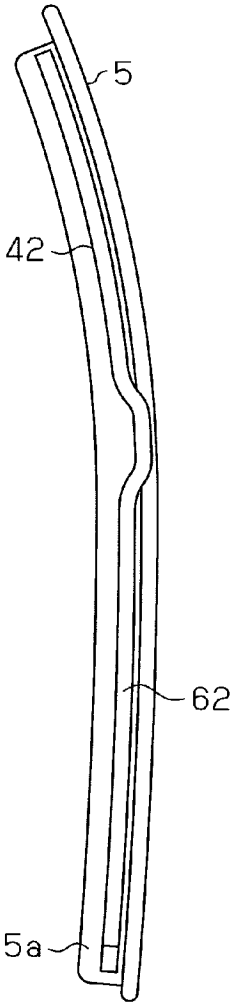
FIG. 4 is a side view showing a door panel mounted on the vehicle of FIG. 1.
Figure 6A:
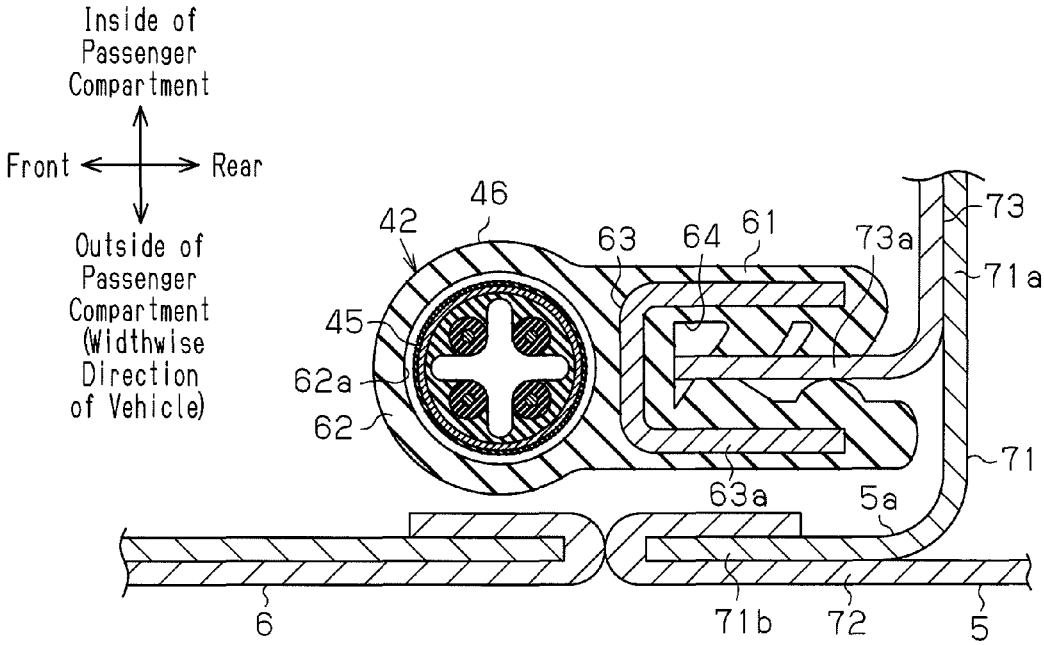
FIG. 6A is a cross-sectional view taken along line 6A-6A in FIG. 2.

As shown in FIG. 4, the sensor portion 42 is provided along a portion located in the leading portion of the rear door panel 5 when the rear door panel 5 is closed, that is, along the front end 5*a* of the rear door panel 5. As shown in FIG. 6A, the sensor portion 42 includes a sensor body 45 and a support member 46 for fixing the sensor body 45 to the rear door panel 5.

Figure 5A:
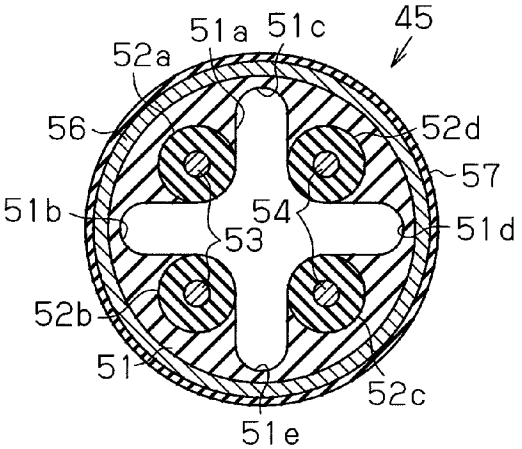
FIG. 5A is a cross-sectional view illustrating a sensor body mounted on the vehicle of FIG. 1.

As shown in FIG. 5A, the sensor body 45 has an elongated shape. An insulating layer 51 is proved at a center portion of the sensor body 45. The insulating layer 51 is substantially cylindrical. The insulating layer 51 is made of an insulating material that has insulation properties and restoring characteristics and can be elastically deformed. The insulating layer 51 is made, for example, of soft synthetic resin or rubber. A separation hole 51*a* is formed in a radially center portion of the insulating layer 51. The separation hole 51*a* extends in the longitudinal direction of the insulating layer 51. The separation hole 51*a* has four separation recesses 51*b* to 51*e*, which form a cross in the cross section along the direction perpendicular to the longitudinal direction of the insulating layer 51 are arranged at equal angular intervals. The separation recesses 51*b* to 51*e* are connected at a radial center of the insulating layer 51 and extend radially outward. In the separation hole 51*a*, the four separation recesses 51*b* to 51*e* each extend helically along the longitudinal direction of the insulating layer 51.

Inside the insulating layer 51, first to fourth electrode wires 52*a* to 52*d* are supported by the insulating layer 51. The electrode wires 52*a* to 52*d* each include a flexible core electrode 53 and a cylindrical conductive coating layer 54. The core electrode 53 is made by twining conductive fine lines, and coated by the conductive coating layer 54. The conductive coating layer 54 has conductivity and elasticity. Each of the electrode wires 52*a* to 52*d* is located between an adjacent pair of the separation recesses 51*b* to 51*e*, and extends helically along the separation recesses 51*b* to 51*e*. More than half the circumferential surface of each of the electrode wires 52*a* to 52*d* is embedded in the insulating layer 51.

A conductive sensor electrode 56 is provided on the outer circumference of the insulating layer 51. The sensor electrode 56 is cylindrical and coats the insulating layer 51 from one end to the other end in the longitudinal direction. The outer circumference of the sensor electrode 56 is coated by a cylindrical outer layer 57. The outer layer 57 is made of an insulating material and can be elastically deformed. The length of the outer layer 57 in the longitudinal direction is equal to the length of the insulating layer 51 in the longitudinal direction.

As shown in FIG. 3, the first electrode wire 52*a* and the third electrode wire 52*c* are electrically connected to each other at first ends in the longitudinal direction (the right ends as viewed in FIG. 3). The second electrode wire 52*b* and the fourth electrode wire 52*d* are electrically connected to each other at first ends in the longitudinal direction (the right ends as viewed in FIG. 3). The third electrode wire 52*c* and the fourth electrode wire 52*d* are electrically connected to each other at a second end in the longitudinal direction (the left end as viewed in FIG. 3) with a resistor 55 in between. A second end of the second electrode wire 52*b* (the left end as viewed in FIG. 3) is connected to a ground GND, or grounded to the vehicle body 3. A second end of the first electrode wire 52*a* (the left end as viewed in FIG. 3) is electrically connected to the ON-OFF detector 43. The first electrode wire 52*a* receives electricity through the control circuit device 81 and the ON-OFF detector 43.

As shown in FIG. 6A, the support member 46 is formed by integrally forming an attaching portion 61 for fixing the support member 46 to the rear door panel 5 and a holding portion 62 for holding the sensor body 45.

The attaching portion 61 is formed by coating a reinforcing member 63 with an insulating resin material that has elasticity and restoring characteristics, such as elastomer or rubber. The reinforcing member 63 is formed by connecting a number of conductive framework members 63*a* having a U-shaped cross section along the up-down direction of the vehicle 2. The length of the attaching portion 61 in the longitudinal direction is substantially equal to the length of the sensor body 45 in the axial direction. Inside the framework members 63*a* of the attaching portion 61, an attaching groove 64 is formed to extend along the longitudinal direction of the attaching portion 61.

Like the attaching portion 61, the cylindrical holding portion 62 is made of an insulating resin material. The holding portion 62 is formed integrally with the attaching portion 61 and is located on the side opposite to the attaching groove 64 when viewed along the axial direction. The length of the holding portion 62 in the axial direction is substantially equal to the length of the sensor body 45 in the axial direction. An insertion hole 62*a* is formed in the holding portion 62. The insertion hole 62*a* extends in the axial direction of the holding portion 62. The inner diameter of the insertion hole 62*a* is slightly greater than the outer diameter of the sensor body 45. The sensor body 45 is inserted into the insertion hole 62*a*.

The support member 46 is fixed to the front end 5*a* of the rear door panel 5 with the sensor body 45 inserted in the insertion hole 62*a*. The rear door panel 5 includes an inner plate 71 located on the inner side of the vehicle and an outer plate 72 located on the outer side of the vehicle. At the front end of the inner plate 71 (at an end in the advancing direction of the vehicle 2), a fixed portion 71*a* and an extended portion 71*b* are formed. The fixed portion 71*a* extends substantially parallel with the widthwise direction of the vehicle, and the extended portion 71*b* extends from the outer end of the fixed portion 71*a* toward the front of the vehicle 2. The distal end of the extended portion 71*b* is covered by the outer plate 72. A bracket 73 having a press-fitted portion 73*a* extending toward the front of the vehicle 2 is fixed to a front surface of the fixed portion 71*a* in the vehicle 2. The bracket 73 extends along the up-down direction of the vehicle 2. The bracket 73 is bent to partially bulge outward of the passenger compartment at a substantially center portion in the longitudinal direction of the bracket 73 (the same as the up-down direction of the vehicle 2). By press fitting the press-fitted portion 73*a* into the attaching groove 64, the bracket 73 is fixed to the press-fitted portion 73*a*, that is, to the front end 5*a* of the rear door panel 5.

Figure 6B:
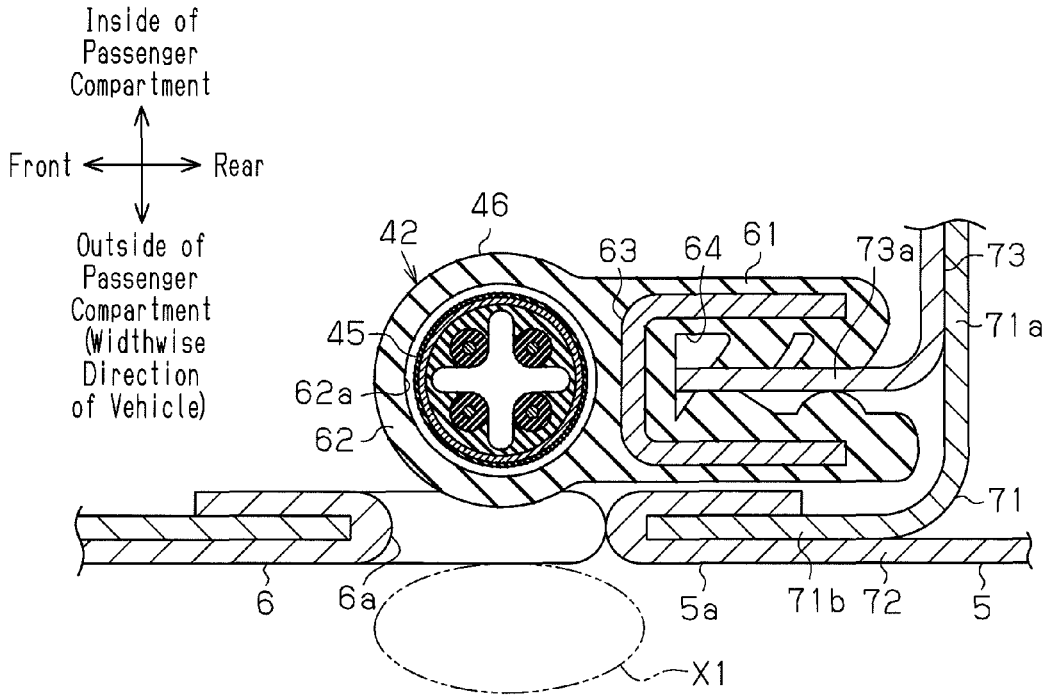
FIG. 6B is a cross-sectional view taken along line 6B-6B in FIG. 2.

In a state where the sensor body 45 is fixed to the rear door panel 5 with the support member 46, the sensor body 45 extends along the front end 5*a* of the rear door panel 5 and projects further forward than the front end of the extended portion 71*b* (the front end including the outer plate 72 covering the extended portion 71*b*). A substantially center portion of the bracket 73 in the longitudinal direction is partially curved outward of the passenger compartment. In a state where the sensor body 45 is fixed to the rear door panel 5 with the support member as shown in FIG. 4, the support member 46 holding the sensor body 45, that is, the sensor portion 42, extends along the bracket 73 with its center portion in the longitudinal direction partially bulges outward of the passenger compartment. As shown in FIG. 2, an exposing recess 6*a* is formed in the rear end of the front door panel 6 at a position corresponding to a part of the sensor portion 42 that is curved outward of the passenger compartment. The outwardly curved part of the sensor portion 42 is exposed to the outside of the vehicle body 3 at the exposing recess 6*a*. The bottom of the exposing recess 6*a* faces the front end of the front door panel 6. When viewed from the side of the vehicle 2, the exposing recess 6*a* has a rectangular shape. As shown in FIG. 6B, the outwardly curved part of the sensor portion 42 is exposed to the outside of the vehicle body 3 from the exposing recess 6*a* when the rear door panel 5 fully closes the door opening 4. Therefore, an object X1 such as a part of a human body is allowed to easily contact the sensor portion 42 (more specifically, the holding portion 62 holding the sensor body 45) through the exposing recess 6*a*.

As shown in FIG. 3, the ON-OFF detector 43, together with the sensor body 45, forms a touch type pressure sensitive sensor that detects an object (not shown) present between the rear door panel 5 and the edge of the door opening 4 when the rear door panel 5 is being closed. The ON-OFF detector 43 is arranged in the rear door panel 5 and is connected to the ground GND.

Figure 5B:
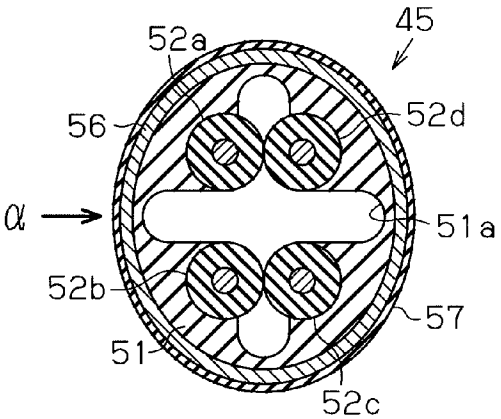
FIG. 5B is a cross-sectional view illustrating the sensor body of FIG. 5A when receiving a pressing force.

As shown in FIGS. 3 and 5A, when no pressing force is applied to the sensor body 45, current supplied to the first electrode wire 52*a* flows through the third electrode wire 52*c*, the resistor 55, the fourth electrode wire 52*d*, and the second electrode wire 52*b* in this order. When a pressing force is applied to the sensor body 45 from the direction of arrow a as shown in FIGS. 3 and 5B, the outer layer 57, the sensor electrode 56, and the insulating layer 51 are elastically deformed. As a result, one of the first electrode wire 52*a* and the third electrode wire 52*c* contacts and is electrically connected to one of the second electrode wire 52*b* and the fourth electrode wire 52*d*. Then, the current supplied to the first electrode wire 52*a* flows to the second electrode wire 52*b* without flowing through the resistor 55. Accordingly, the voltage value between the first electrode wire 52*a* and the ground GND when no pressing force is applied to the sensor body 45 is different from that when a pressing force is applied to the sensor body 45. The ON-OFF detector 43 detects changes in the voltage value between the first electrode wire 52*a* and the ground GND, and outputs a voltage detection signal indicating a change in the voltage value, that is, a foreign object contact signal, to the control circuit device 81. For example, the ON-OFF detector 43 has a threshold value that has been determined based on the voltage value between the first electrode wire 52*a* and the ground GND in a state where no pressing force is being applied to the sensor body 45. When the voltage value between the first electrode wire 52*a* and the ground GND exceeds the threshold value, the ON-OFF detector 43 outputs a foreign object contact signal. When the pressing force applied to the sensor body 45 is removed, the shapes of the outer layer 57, the sensor electrode 56, and the insulating layer 51 are restored, and the shapes of the first to fourth electrode wires 52*a* to 52*d* are restored.

As shown in FIG. 3, the capacitance detecting circuit 44 is electrically connected to the sensor electrode 56. The capacitance detecting circuit 44 and the sensor electrode 56 form a capacitance type proximity sensor that detects without any physical contact the presence of a conductive object existing between the rear door panel 5 and the edge of the door opening 4 when the rear door panel 5 is being closed. The capacitance detecting circuit 44 and the sensor electrode 56 form a touch sensor that detects contact of a conductive object with the sensor portion 42 when the rear door panel 5 is not being moved.

The capacitance detecting circuit 44 is arranged in the rear door panel 5. The capacitance detecting circuit 44 is electrically connected to the control circuit device 81. The capacitance detecting circuit 44 detects the capacitance between the sensor electrode 56 and an object in the proximity of the sensor electrode 56 (for example, the ground surface, the front door panel 6, a part of a human body, and a conductive foreign object). That is, based on an electrical signal that is sent from the sensor electrode 56 of the sensor body 45 and indicates the distance between the sensor electrode 56 and an object, the capacitance detecting circuit 44 detects the capacitance of the sensor electrode 56. The capacitance detecting circuit 44 outputs the detected capacitance of the sensor electrode 56 (detection value) to the control circuit device 81.

The power sliding door apparatus 1 in the present embodiment is controlled by the control circuit device 81. The control circuit device 81 functions as a microcomputer that includes a ROM (Read Only Memory) and a RAM (Random Access Memory). The control circuit device 81 is located, for example, in the vicinity of the slide motor 26, and supplied with drive power from a battery 82 of the vehicle 2.

The control circuit device 81 controls the slide actuator 25 and the closure actuator 28 based on various types of signals sent from the half latch detecting portion, the position detector 27, the operation switch 31, the ON-OFF detector 43, and the capacitance detecting circuit 44.

The control circuit device 81 includes a determination circuit 81*a*. The determination circuit 81*a* has a first threshold value Th1 and a second threshold value Th2. The first threshold value Th1 is a threshold value for determining that a conductive object contacts the sensor portion 42. The second threshold value Th1 is a threshold value for determining that a conductive object is in the proximity of the sensor portion 42. When the rear door panel 5 is not being moved, the determination circuit 81*a* compares the first threshold value Th1 with a detection value output from the capacitance detecting circuit 44. Based on the comparison result, the determination circuit 81*a* determines whether there is a conductive object contacting the sensor portion 42. In the present embodiment, when the detection value output from the capacitance detecting circuit 44 is greater than the first threshold value Th1, the determination circuit 81*a* determines that an object is contacting the sensor portion 42, and outputs a contact detection signal indicating that the object is contacting the sensor portion 42. Also, when the rear door panel 5 is being closed, the determination circuit 81*a* compares the second threshold value Th2 with a detection value output from the capacitance detecting circuit 44. Based on the comparison result, the determination circuit 81*a* determines whether there is an object in the proximity of the sensor portion 42. In the present embodiment, when the detection value is greater than the second threshold value Th2, the determination circuit 81*a* determines that there is an object in the proximity of the sensor portion 42, and outputs a foreign object proximity signal indicating that the object is in the proximity of the sensor portion 42. The first threshold value Th1 is set based on the capacitance that is actually detected by the capacitance detecting circuit 44 when an object contacts the sensor portion 42 exposed through the exposing recess 6*a*. The second threshold value Th2 is set based on the capacitance that is actually detected by the capacitance detecting circuit 44 when the rear door panel 5 is being closed with no object between the edge of the door opening 4 and the front end of the rear door panel 5.

The operation of the power sliding door apparatus 1 will now be described.

When receiving an open signal from the operation switch 31, the control circuit device 81 outputs a drive signal to the slide motor 26 to open the rear door panel 5. When the rear door panel 5 reaches a position where the door opening 4 is fully open, the control circuit device 81 stops the slide motor 26. Based on the rotation detection signals sent from the position detector 27, the control circuit device 81 monitors the position of the rear door panel 5.

When the rear door panel 5 is not being moved but is likely to be opened, for example, when an electronic key of an electronic key system mounted on the vehicle 2 transmits a signal instructing locking or unlocking of the rear door panel 5 and a control device (not shown) in the vehicle 2 is receiving the signal, the control circuit device 81 is activated to activate the capacitance detecting circuit 44. When a detection value output from the capacitance detecting circuit 44 exceeds the first threshold value Th1 due to contact of a conductive object such as a part of a human body with the sensor portion 42, the determination circuit 81*a* outputs a contact detection signal. When a contact detection signal is output from the determination circuit 81*a*, the control circuit device 81 controls the closure motor 29 and the slide motor 26 so as to open the rear door panel 5. When the rear door panel 5 reaches a position where the door opening 4 is fully open, the control circuit device 81 stops the slide motor 26. When the door opening 4 is closed by the rear door panel 5, the sensor portion 42 can be touched through the exposing recess 6*a*.

When receiving a close signal from the operation switch 31, the control circuit device 81 activates the ON-OFF detector 43 and the capacitance detecting circuit 44, and controls the slide motor 26 to close the rear door panel 5. When receiving a half latch detection signal from the half latch detecting portion while the rear door panel 5 is being closed, the control circuit device 81 controls the closure motor 29 such that the rear door panel 5 is moved to a position where the rear door panel 5 can be locked by the lock mechanism. When the rear door panel 5 closes the door opening 4, the control circuit device 81 stops the slide motor 26 and the closure motor 29.

If a conductive object exists between the edge of the door opening 4 and the rear door panel 5 when the rear door panel 5 is being closed, the distance between the sensor portion 42 and the object decreases as the rear door panel 5 moves. Accordingly, the detection value output from the capacitance detecting circuit 44 exceeds the second threshold value Th2. When the detection value output by the capacitance detecting circuit 44 exceeds the second threshold value Th2, the determination circuit 81*a* outputs a foreign object proximity signal. When the determination circuit 81*a* outputs a foreign object proximity signal, the control circuit device 81 reverses the slide motor 26, thereby opening the rear door panel 5 (reverse operation) by a predetermined amount.

If the sensor portion 42 is deformed by contacting an object when the rear door panel 5 is being closed, the control circuit device 81 receives a foreign object contact signal from the ON-OFF detector 43. When receiving a foreign object contact signal, the control circuit device 81 reverses the slide motor 26, thereby opening the rear door panel 5 (reverse operation) by a predetermined amount.

The present embodiment has the following advantages.

(1) Since a part of the sensor portion 42 is exposed to the outside of the vehicle body 3 through the exposing recess 6*a* provided at the rear end of the front door panel 6, an object such as a part of a human body is allowed to contact the sensor portion 42 when the rear door panel 5 is not being moved. If the capacitance detecting circuit 44 and the determination circuit 81*a* detect that an object contacts the sensor portion 42 when the rear door panel 5 is not being moved, the control circuit device 81 controls the closure motor 29 and the slide motor 26 to open the rear door panel 5. As a result, the rear door panel 5 is opened due to the contact of the object with the sensor portion 42. If the capacitance detecting circuit 44 and the determination circuit 81*a* detect that an object has approached the sensor portion 42 when the rear door panel 5 is being closed, the control circuit device 81 controls the slide motor 26 to reverse the movement of the rear door panel 5. As a result, the object is prevented from being caught between the edge of the door opening 4 and the rear door panel 5. Therefore, the single sensor portion 42 functions as a sensor that prevents an object from being caught between the edge of the door opening 4 and the rear door panel 5 and a sensor that detects contact of an object to start opening the rear door panel 5. The sensor portion 42 is located in the front end 5*a* of the rear door panel 5. As a result, the number of components in the power sliding door apparatus 1 is reduced. Accordingly, it is possible to reduce the assembly steps of the power sliding door apparatus 1 having a function for preventing an objective from being caught between the edge of the door opening 4 and the rear door panel 5 and a function for starting opening the rear door panel 5 based on the contact of the object.

A description will be given below of a second embodiment of the present invention with reference to the accompanying drawings. Like or the same reference numerals are given to those components that are like or the same as the corresponding components of the first embodiment and detailed explanations are omitted.

Figure 7:
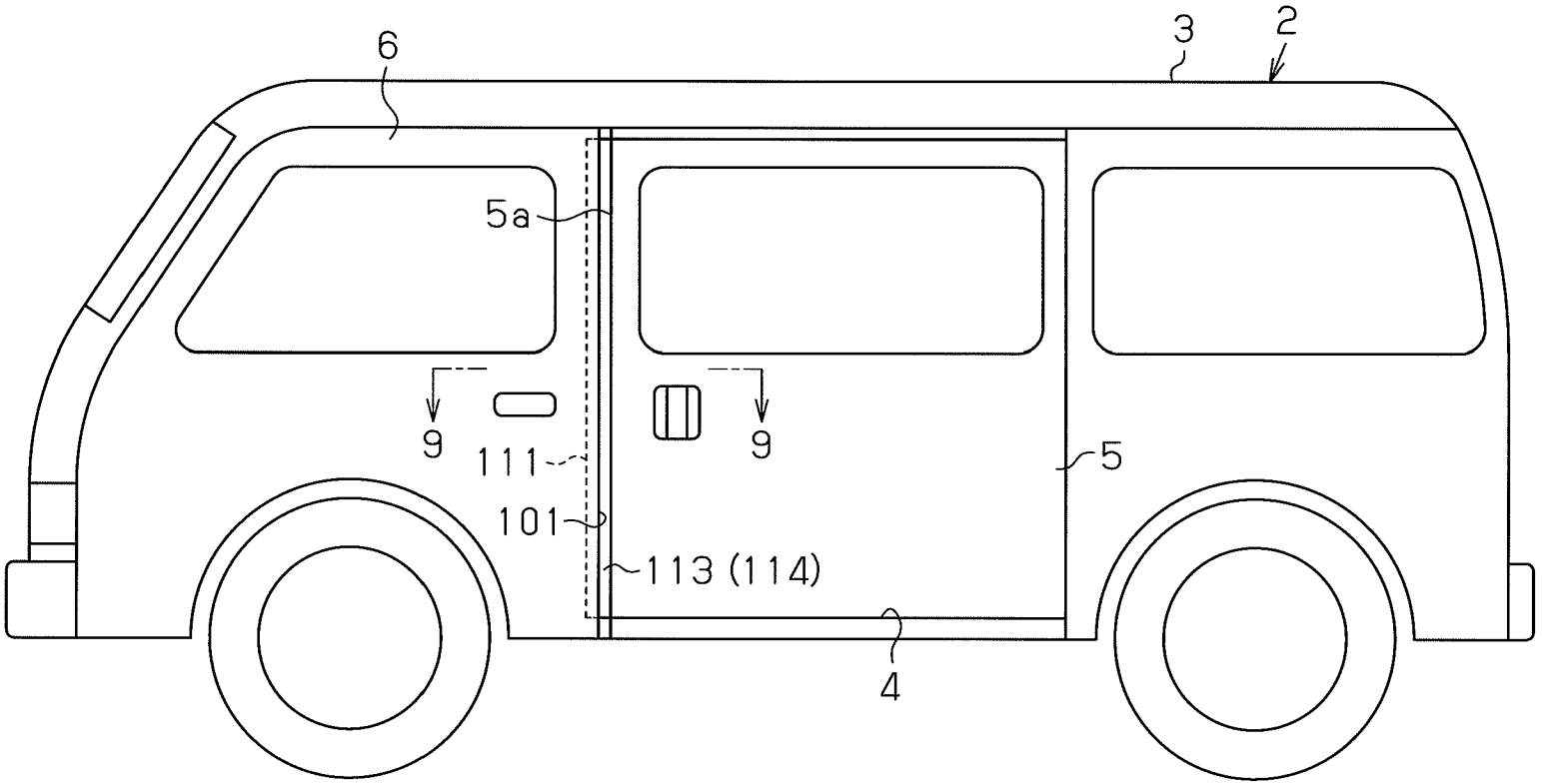
FIG. 7 is a side view illustrating a vehicle equipped with a power sliding door apparatus according to a second embodiment of the present invention.
Figure 9:
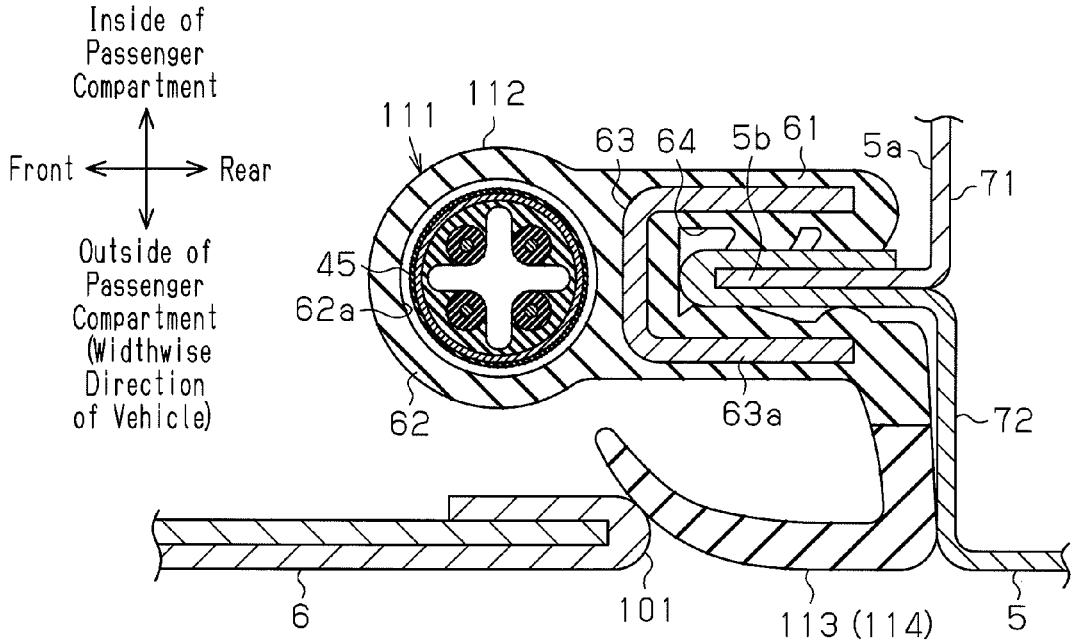
FIG. 9 is a cross-sectional view taken along line 9-9 in FIG. 7.

As shown in FIG. 7, no exposing recess 6*a* is formed in the front door panel 6 in the present embodiment. A small gap 101 exists between the front end of the rear door panel 5 and the rear end of the front door panel 6 when the door opening 4 is closed. As shown in FIG. 9, a press-fitted portion 5*b* projecting forward is formed on the front end 5*a* of the rear door panel 5. The press-fitted portion 5*b* is formed by the inner plate 71 and the outer plate 72, which form the rear door panel 5. The press-fitted portion 5*b* extends from the upper end to the lower end of the rear door panel 5 along the front end 5*a*. A sensor portion 111 is fixed to the front end 5*a* of the rear door panel 5 by press-fitting the press-fitted portion 5*b* of the support member 112 into the attaching groove 64.

The support member 112, which forms the sensor portion 111, includes a sealing portion 113, which is formed integrally with the attaching portion 61. The sealing portion 113 extends outward from an outer end of the attaching portion 61, and an opening end of the attaching groove 64 (that is, the rear end of the attaching portion 61 in the vehicle 2). Specifically, the sealing portion 113 extends substantially parallel with the widthwise direction of the vehicle from the attaching portion 61, and extends toward the front of the vehicle 2. The distal end of the sealing portion 113 is curved inward of the passenger compartment. When viewed from above the vehicle 2, the sealing portion 113 substantially has an L-shape. The sealing portion 113 is formed along the entire length of the attaching portion 61. The width of the sealing portion 113 along the front-rear direction of the vehicle 2 is greater than the width of the gap 101 between the front door panel 6 and the rear door panel 5 (the width of the gap 101 along the front-rear direction of the vehicle 2).

When the door opening 4 is fully closed by the rear door panel 5, the sealing portion 113 is exposed to the outside of the vehicle 2 through the gap 101, and closes the gap 101 to prevent water from entering the passenger compartment. Also, when the door opening 4 is fully closed by the rear door panel 5, the outer side of the sealing portion 113 is arranged on the outer side surface of the rear door panel 5 and the outer side surface of the front door panel 6.

Figure 8:
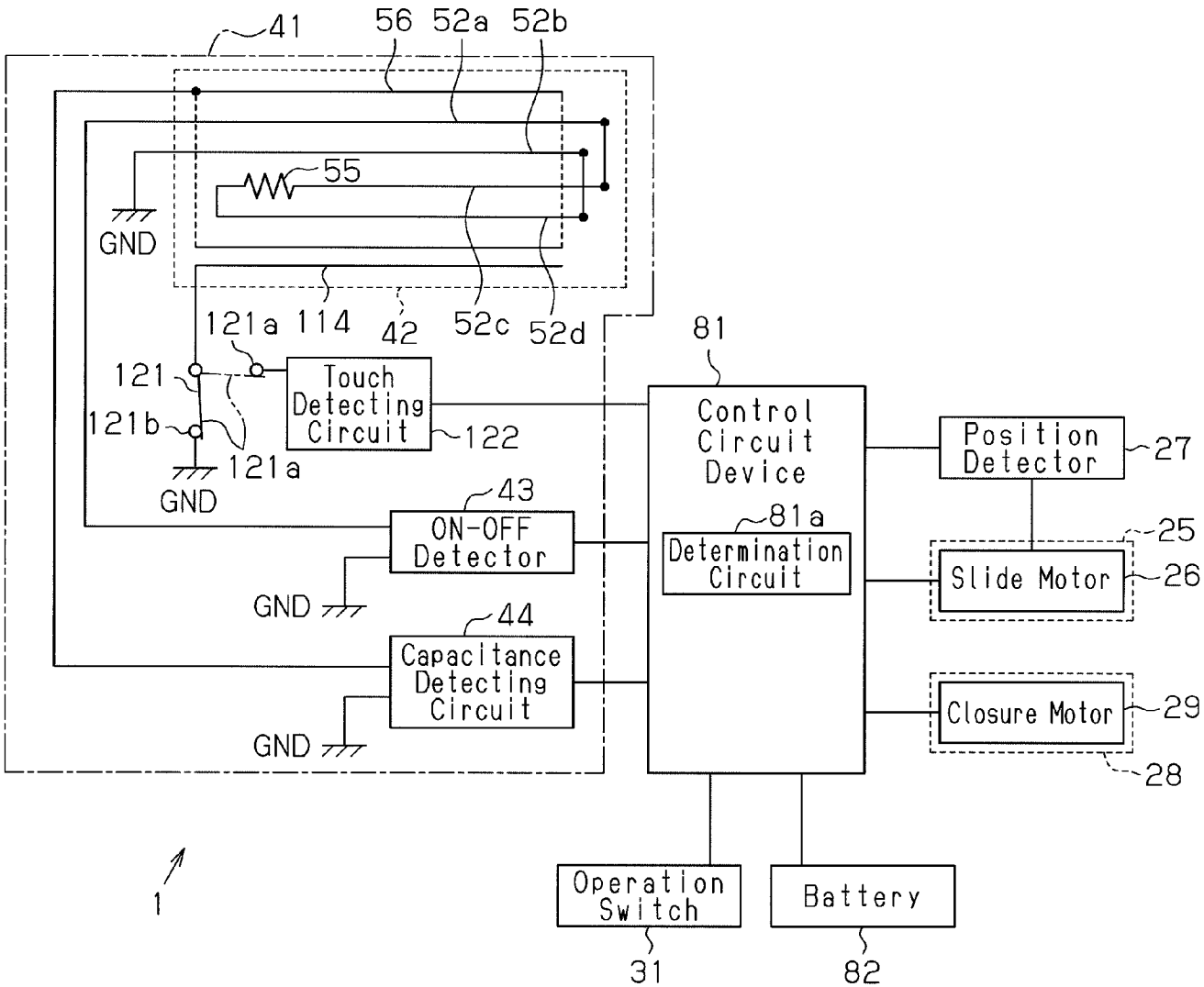
FIG. 8 is an electrical configuration of the power sliding door apparatus of FIG. 7.

The sealing portion 113 is made of an elastic and conductive resin material. The sealing portion 113 also functions as a touch sensing electrode 114. The attaching portion 61, the holding portion 62, and the sealing portion 113 (the touch sensing electrode 114) of the support member 112 are simultaneously formed by extrusion molding. As shown in FIG. 8, the sealing portion 113, which also functions as the touch sensing electrode 114, is electrically connected to the control circuit device 81 through a changeover switch 121 and a touch detecting circuit 122.

The sealing portion 113 (the touch sensing electrode 114) is electrically connected to a changeover piece 121*a* of the changeover switch 121. The changeover switch 121 has a first contact point 121*b* connected to the ground GND (grounded to the vehicle body 39 and a second contact point 121*c* electrically connected to the touch detecting circuit 122. The changeover switch 121 is controlled by the control circuit device 81. When the changeover piece 121*a* is connected to the first contact point 121*b*, the touch sensing electrode 114 is grounded through the first contact point 121*b*, so that the changeover piece 121*a* is connected to the second contact point 121*c*. Then, the touch sensing electrode 114 is electrically connected to the touch sensing electrode 14 via the second contact point 121*c*.

Together with the touch sensing electrode 114, the touch detecting circuit 122 forms a capacitance type touch sensor that detects whether an object contacts the sealing portion 113 (touch sensing electrode 114) based on a change in the capacitance of the touch sensing electrode 114. The touch detecting circuit 122 has a threshold value for detecting that an object contacts the sealing portion 113 (the touch sensing electrode 114). With the changeover piece 121*a* being connected to the second contact point 121*c*, if the capacitance of the touch sensing electrode 114 exceeds the threshold value due to contact of a conductive object such as a part of a human body with the sealing portion 113, the touch detecting circuit 122 outputs a contact detection signal to the control circuit device 81.

The operation of the power sliding door apparatus 1 according to the present embodiment will now be described. In the power sliding door apparatus 1 of the present embodiment, contact of an object with the touch sensing electrode 114 is detected by the touch detecting circuit 122. Thus, the determination circuit 81*a* does not have the first threshold value Th1 for detecting contact of a conductive object with the sensor portion 111.

As in the first embodiment, the control circuit device 81 controls the slide motor 26 to open the rear door panel 5 when receiving an open signal from the operation switch 31. When the rear door panel 5 reaches a position where the door opening 4 is fully open, the control circuit device 81 stops the slide motor 26.

When the rear door panel 5 is not being moved but is likely to be opened, for example, when an electronic key of an electronic key system mounted on the vehicle 2 transmits a signal instructing locking or unlocking of the rear door panel 5 and a control device (not shown) in the vehicle 2 is receiving the signal, the control circuit device 81 is activated and controls the changeover switch 121 such that the changeover piece 121*a* contacts the second contact point 121*c*. The control circuit device 81 also activates the touch detecting circuit 122. When a conductive object such as a part of a human body contacts the sealing portion 113 (touch sensing electrode 114) exposed through the gap 101 and the touch detecting circuit 122 outputs a contact detection signal, the control circuit device 81 controls the closure motor 29 and the slide motor 26 to open the rear door panel 5. When the rear door panel 5 reaches a position where the door opening 4 is fully open, the control circuit device 81 stops the slide motor 26. Also, the control circuit device 81 controls the changeover switch 121 to connect the changeover piece 121*a* to the first contact point 121*b*.

On the other hand, when receiving a close signal from the operation switch 31, the control circuit device 81 activates the ON-OFF detector 43 and the capacitance detecting circuit 44, and controls the slide motor 26 to close the rear door panel 5. When receiving a half latch detection signal from the half latch detecting portion while the rear door panel 5 is being closed, the control circuit device 81 controls the closure motor 29 such that the rear door panel 5 is moved to a position where the rear door panel 5 can be locked by the lock mechanism. When the rear door panel 5 closes the door opening 4, the control circuit device 81 stops the slide motor 26 and the closure motor 29.

If a conductive object exists between the edge of the door opening 4 and the rear door panel 5 when the rear door panel 5 is being closed, the distance between the sensor portion 111 and the object decreases as the rear door panel 5 moves. Accordingly, the detection value output from the capacitance detecting circuit 44 exceeds the second threshold value Th2. When the detection value output by the capacitance detecting circuit 44 exceeds the second threshold value Th2, the determination circuit 81*a* outputs a foreign object proximity signal. When the determination circuit 81*a* outputs a foreign object proximity signal, the control circuit device 81 reverses the slide motor 26, thereby opening the rear door panel 5 (reverse operation) by a predetermined amount. When the rear door panel 5 is being closed, the changeover piece 121*a* is connected to the first contact point 121*b* so that the touch sensing electrode 114 is grounded. Thus, the touch sensing electrode 114 functions as a shielded electrode on the side of the sensor body 45.

When receiving a foreign object contact signal from the ON-OFF detector 43 while the rear door panel 5 is being closed, the control circuit device 81 reverses the slide motor 26, thereby opening the rear door panel 5 (reverse operation) by a predetermined amount.

The present embodiment has the following advantages.

(1) Since the sealing portion 113 of the sensor portion 111 is exposed to the outside of the vehicle body 3 through the gap 101 when the rear door panel 5 fully closes the door opening 4, no object can contact the sealing portion 113 from the outside when the rear door panel 5 is not being moved. If the touch detecting circuit 122 detects contact of an object with the sealing portion 113 when the rear door panel 5 is not being moved, the control circuit device 81 controls the closure motor 29 and the slide motor 26 to open the rear door panel 5. Therefore, the rear door panel 5 can be opened by the contact of an object with the sealing portion 113. While the rear door panel 5 is being closed, if the capacitance detecting circuit 44 and the determination circuit 81*a* detect an object in the proximity of the sensor portion 111, the control circuit device 81 controls the slide motor 26 to reverse the movement of the rear door panel 5. This inhibit the object from being caught between the edge of the door opening 4 and the rear door panel 5. Therefore, the single sensor portion 111 functions as a sensor that prevents an object from being caught between the edge of the door opening 4 and the rear door panel 5 and a sensor that detects contact of an object to start opening the rear door panel 5. The sensor portion 111 is located in the front end 5*a* of the rear door panel 5. As a result, the number of components in the power sliding door apparatus 1 is reduced, and it is possible to reduce the assembly steps of the power sliding door apparatus 1 having a function for preventing an objective from being caught between the edge of the door opening 4 and the rear door panel 5 and a function for starting opening the rear door panel 5 based on the contact of the object.

(2) The sealing portion 113 closes the gap 101 between the front end 5*a* of the rear door panel 5 and the edge of the door opening 4 when the rear door panel 5 fully closes the door opening 4, and also functions as the touch sensing electrode 114. Since the sealing portion 113 is exposed to the outside of the vehicle body 3 through the gap 101, an object can easily contact the sealing portion 113, that is, the touch sensing electrode 114, from the outside of the vehicle body 3. The rear door panel 5 can be opened based on the contact of an object with the sealing portion 113.

(3) Being made of a conductive resin material, the touch sensing electrode 114 can be formed simultaneously with the attaching portion 61 and the holding portion 62, which are made of an insulating resin material, by extrusion molding. Also, since the sealing portion 113, which also functions as the touch sensing electrode 114, is made of a conductive resin material, its elasticity is easily ensured.

(4) Since the touch sensing electrode 114 is grounded to the vehicle body 3 when the rear door panel 5 is closed, the touch sensing electrode 114 functions as a shielded electrode on a side of the sensor body 45. By adjusting the range in which the touch sensing electrode 114 is formed, the detection range in which the sensor body 45 can detect an object in the proximity can be limited. This prevents erroneous detection of an object in the proximity of the sensor portion 111 when the rear door panel 5 is being closed. That is, the rear door panel 5 is inhibited from malfunctioning.

(5) Since the touch sensing electrode 114 is composed of the sealing portion 113, which closes the gap 101 between the rear door panel 5 and the front door panel 6, the sensor portion 111 is easily exposed to the outside of the vehicle body 3 without significantly changing the shape of the vehicle 2, such as the shapes of the rear door panel 5 and the front door panel 6.

The embodiments of the present invention may be modified as follows.

In the second embodiment, the touch sensing electrode 114 is connected to the touch detecting circuit 122 by the changeover switch 121 when the rear door panel 5 is not being moved. The touch sensing electrode 114 is grounded to the vehicle body 3 when the rear door panel 5 is being closed However, the touch sensing electrode 114 may be always connected to the touch detecting circuit 122. In this case, the changeover switch 121 may omitted.

Figure 10:
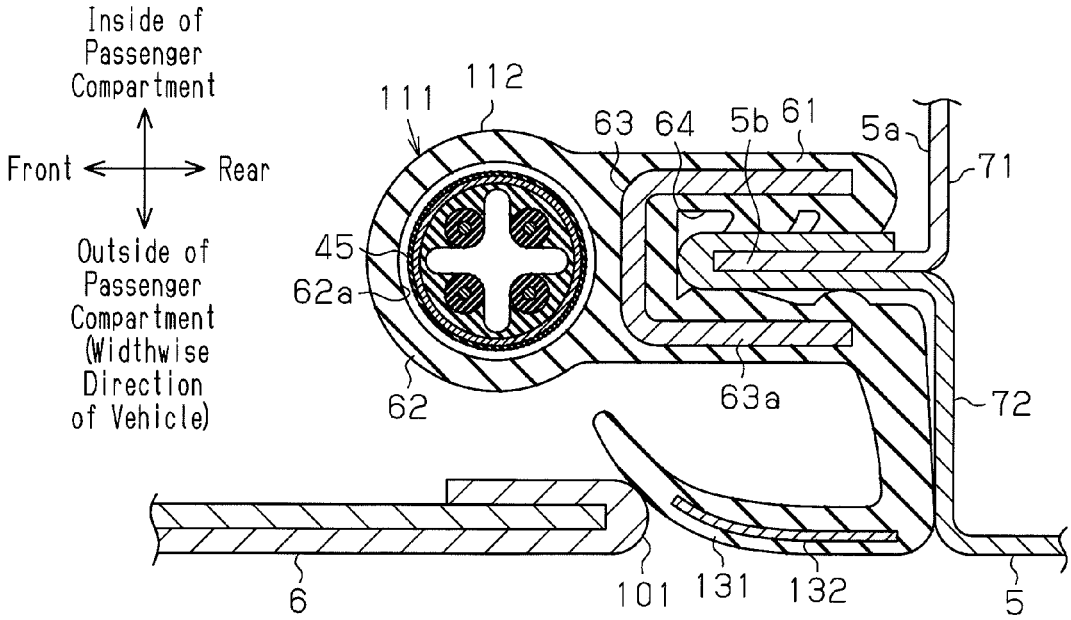
FIG. 10 is a cross-sectional view illustrating a support member according to another embodiment.
Figure 11:
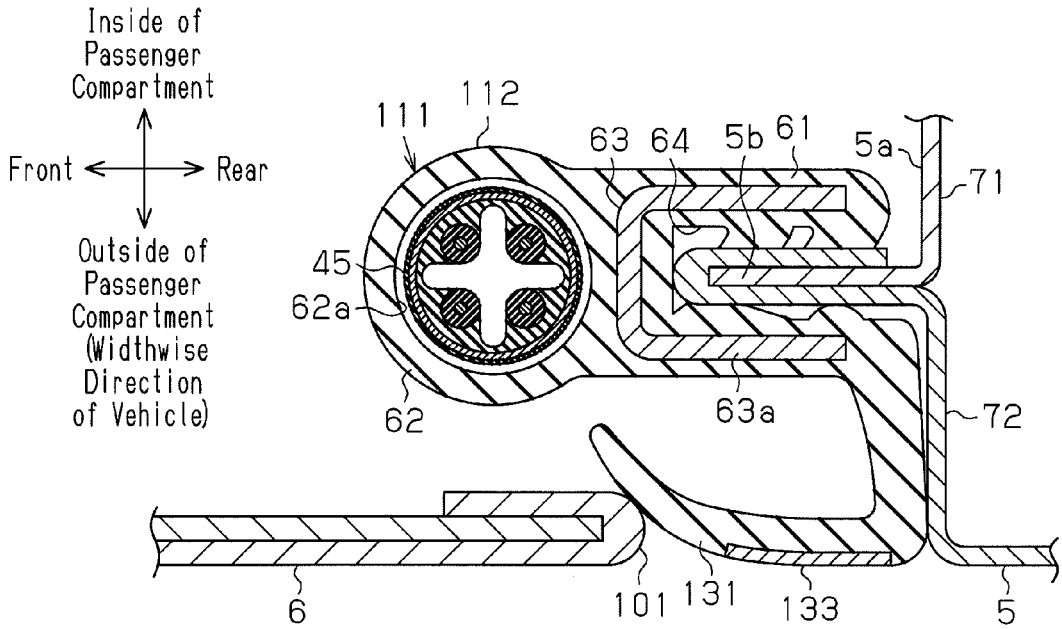
FIG. 11 is a cross-sectional view illustrating a support member according to another embodiment.
Figure 12:
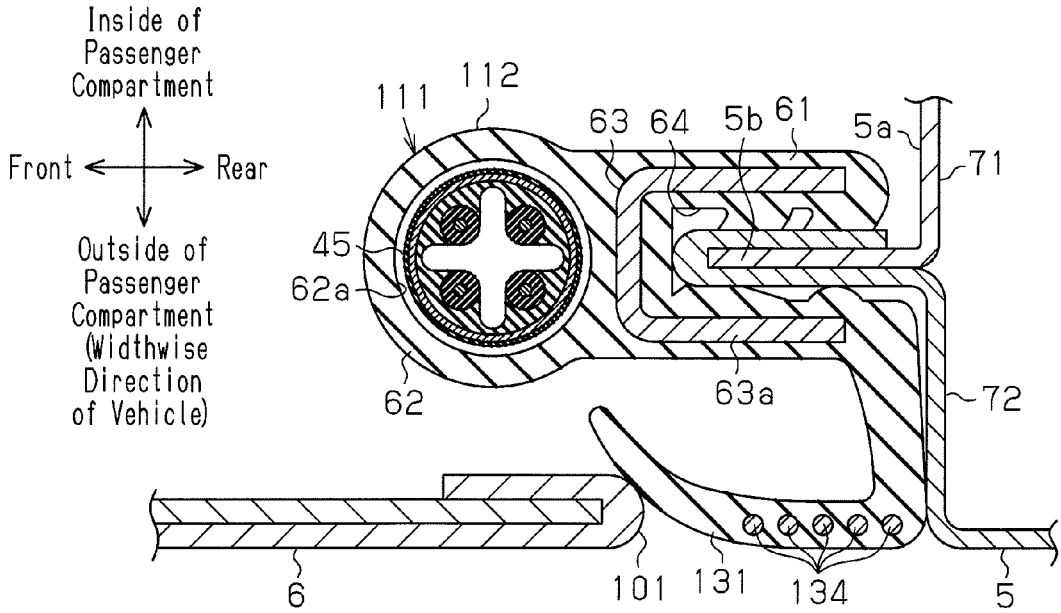
FIG. 12 is a cross-sectional view illustrating a support member according to another embodiment.

In the second embodiment, the touch sensing electrode 114 is composed of the sealing portion 113, which is formed by a conductive resin material. However, as long as the touch sensing electrode 114 is provided at the sealing portion, the shape and number of the touch sensing electrode 114 are not limited to those in the second embodiment. For example, in an example shown in FIG. 10, a sealing portion 131 is made of an insulating resin material as in the case of the attaching portion 61 and the holding portion 62. A touch sensing electrode 132 is made of a conductive metal material or a conductive resin material, and is shaped like a belt extending in the up-down direction of the vehicle. The touch sensing electrode 132 is embedded in the sealing portion 131. In an example of FIG. 11, a touch sensing electrode 133 is made of a conductive metal material or a conductive resin material. The touch sensing electrode 133 is provided to be exposed through the outer side surface of the sealing portion 131. Further, in an example of FIG. 12, a plurality of touch sensing electrodes 134 are provided in the sealing portion 131, and are made of a conductive metal material or a conductive resin material. The touch sensing electrodes 134 embedded in the sealing portion 131 are formed like cords each extending in the up-down direction of the vehicle having a circular cross-section. The touch sensing electrodes 134 are arranged along the front-rear direction of the vehicle while being spaced from one another. The touch sensing electrodes 134 are electrically connected to the touch detecting circuit 122. These modifications have the same advantages as (1), (2), and (5) of the second embodiment. When the touch sensing electrodes 132, 133, 134 are made of conductive resin materials, the same advantage as (3) of the second embodiment can be achieved. Further, since the touch sensing electrodes 132, 134 are embedded in the sealing portion 131 made of an insulating resin material, unnecessary short circuiting of the touch sensing electrodes 132, 134 is inhibited.

Figure 13:
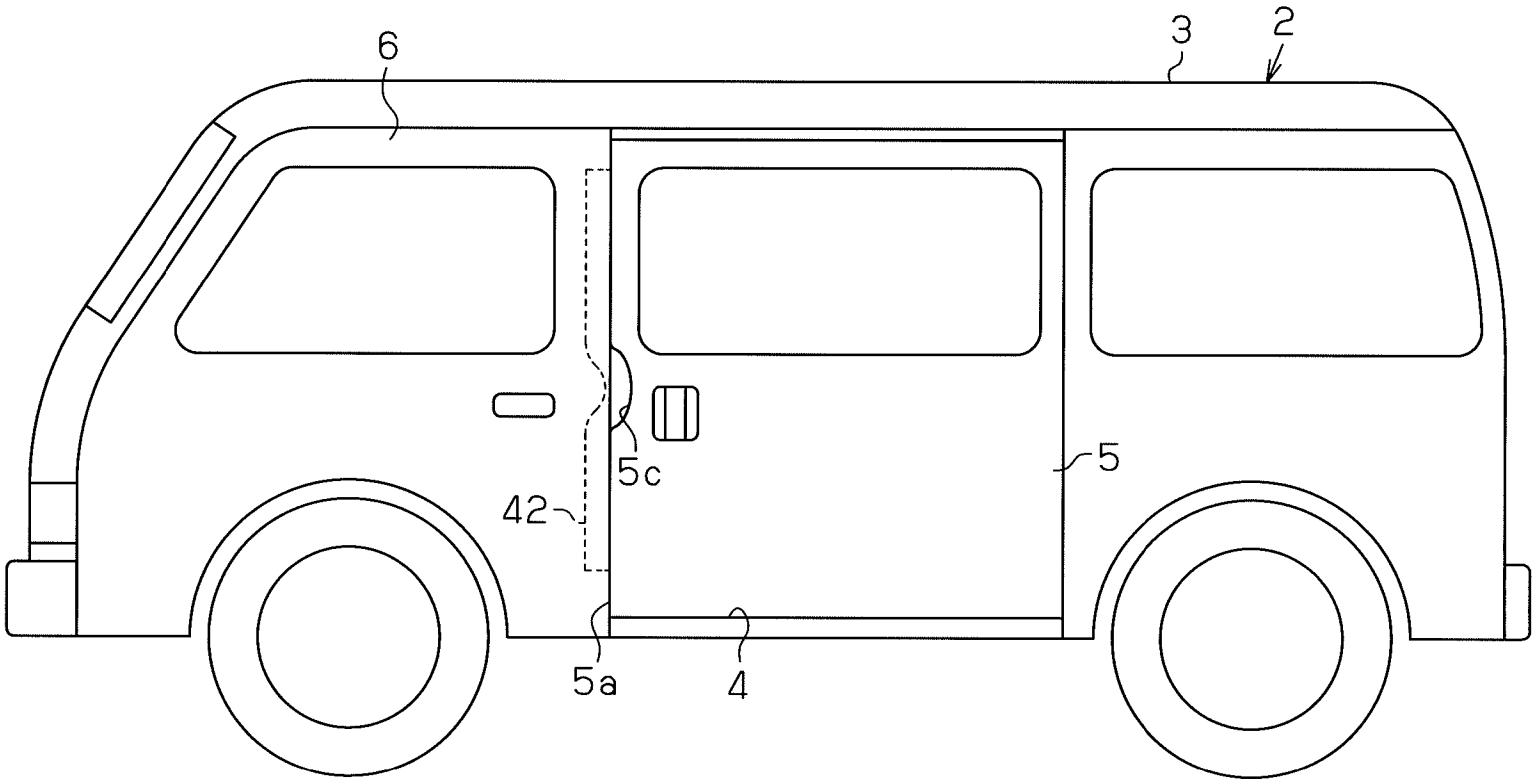
FIG. 13 is a side view illustrating a vehicle according to another embodiment.

In the first embodiment, the exposing recess 6*a* is provided in the rear end of the front door panel 6, and a part of the sensor portion 42 is exposed to the outside of the vehicle body 3 through the exposing recess 6*a*. However, the configuration is not limited to this. For example, as shown in FIG. 13, an exposing recess 5*c* may be formed in the front end of the rear door panel 5, so that the sensor portion 42 is exposed through the exposing recess 5*c*. In this case, a substantially center portion of the sensor portion 42 in the longitudinal direction is curved rearward so that a part thereof can be exposed through the exposing recess 5*c*.

In each of the embodiments, the control circuit device 81 controls the slide motor 26 to reverse the direction of movement of the rear door panel 5 if a foreign object contact signal or a foreign object proximity signal is outputted when the rear door panel 5 is being closed. However, the control circuit device 81 may controls the slide motor 26 to stop the movement of the rear door panel 5 if a foreign object contact signal or a foreign object proximity signal is outputted when the rear door panel 5 is being closed.

In the above embodiments, the present invention is applied to the power sliding door apparatus 1, in which the rear door panel 5 is slid by the drive power of the slide motor 26, thereby opening or closing the door opening 4 provided on the left side of the vehicle 2. However, the present invention may be applied to an opening and closing apparatus other than the sliding door apparatus 1 of the above embodiments as long as the apparatus moves a door panel by the drive power of a drive motor to open and close an opening. For example, the present invention may be applied to an opening and closing apparatus that opens and closes a tail opening of a vehicle using a flip-up backdoor.

What is claimed is:

1. An opening and closing apparatus comprising:

an opening and closing body having a predetermined height for opening and closing an opening formed in an opened and closed body;

a drive portion actuating the opening and closing body;

a detecting device that has a sensor portion for detecting the capacitance between the sensor portion an object that is in the proximity of the sensor portion or is contacting the sensor portion, the sensor portion being located at a closing end of the opening and closing body that is on the leading side when the opening and closing body is being closed, wherein at least part of the sensor portion is exposed to the outside of the opened and closed body by an exposing recess formed in the opened and closed body, said exposing recess having a height that is shorter than the predetermined height of the opening when the opening is fully closed by the opening and closing body, and wherein the detecting device detects whether or not the object is in the proximity of the sensor portion or is contacting the sensor portion based on the capacitance detected by the sensor portion; and a control portion controlling the drive portions, wherein, if the detecting device detects contact of the object with the sensor portion when the opening and closing body is not being moved, the control portion controls the drive portion to start opening the opening and closing body, and wherein, if the detecting device detects that the object is in the proximity of the sensor portion when the opening and closing body is being closed, the control portion controls the drive portion to stop or reverse the movement of the opening and closing body.

2. The pending and closing apparatus according to claim 1, wherein the opened and closed body is a vehicle body, wherein the opening is a door opening provided in a side of the vehicle body, wherein the opening and closing body is a door panel that opens and closes the door opening, and wherein the drive portion is a drive motor, drive power of the drive motor being transmitted to the door panel.

* * * * *